US005413546A

United States Patent [19]

Basile

[11] Patent Number: 5,413,546

[45] Date of Patent: May 9, 1995

[54] BICEP EXERCISE DEVICE

[76] Inventor: Vincent F. Basile, 19 Rosen Street, Epping, New South Wales 2121, Australia

[21] Appl. No.: 124,574

[22] Filed: Sep. 20, 1993

Related U.S. Application Data

[63] Continuation of Ser. No. 791,907, Nov. 13, 1991, abandoned.

[30] Foreign Application Priority Data

Nov. 13, 1990 [AU] Australia ..... PK3336

[51] Int. Cl.[6] ..... A63B 21/22

[52] U.S. Cl. ..... 482/99; 482/100; 482/137

[58] Field of Search ..... 482/10, 97–103, 482/112–113, 115–119, 133–139, 903

[56] References Cited

U.S. PATENT DOCUMENTS

| | | | |
|---|---|---|---|
| 4,235,437 | 11/1980 | Buis et al. | 482/137 X |
| 4,296,924 | 10/1981 | Anzaldua et al. | 482/139 |
| 4,373,717 | 2/1983 | Lambert, Jr. | 482/139 X |
| 4,411,424 | 10/1983 | Barnett | 482/99 |
| 4,556,216 | 12/1985 | Pitkanen | 482/137 X |
| 4,600,188 | 7/1986 | Bangerter et al. | 482/100 X |
| 4,629,185 | 12/1986 | Amann | 482/113 |
| 4,640,268 | 2/1987 | Roberts | 482/139 X |
| 4,765,611 | 8/1988 | MacMillan | 482/98 |
| 4,768,779 | 9/1988 | Oehman, Jr. et al. | 482/112 X |
| 4,768,783 | 9/1988 | Engalitcheff, Jr. | 482/139 |
| 4,772,015 | 9/1988 | Carlson et al. | 482/903 X |
| 4,773,398 | 9/1988 | Tatom | 482/139 X |
| 4,799,670 | 1/1989 | Williamson | 482/136 X |
| 4,817,943 | 4/1989 | Pipasik | 482/137 X |
| 4,872,668 | 10/1989 | McGillis et al. | 482/113 |
| 4,898,381 | 2/1990 | Gordon | 482/103 |
| 4,934,695 | 6/1990 | Wolff | 482/113 X |
| 4,949,951 | 8/1990 | Peola | 482/100 X |
| 4,953,855 | 9/1990 | Shields | 482/99 |
| 4,957,281 | 9/1990 | Christolear, Jr. | 482/100 |
| 4,986,538 | 1/1991 | Ish, III | 482/100 X |
| 5,094,449 | 3/1992 | Stearns | 482/137 X |

FOREIGN PATENT DOCUMENTS

| | | | |
|---|---|---|---|
| 2223686 | 4/1990 | United Kingdom | 482/100 |
| 1243747 | 7/1986 | U.S.S.R. | 482/100 |

OTHER PUBLICATIONS

Search Report 9124055.6.

*Primary Examiner*—Richard J. Apley
*Assistant Examiner*—John Mulcahy
*Attorney, Agent, or Firm*—Ladas & Parry

[57] ABSTRACT

An exercise machine which includes a base which supports the user. Mounted on the base and to be manipulated by the user is a pair of arm assemblies, with each assembly including a lever which pivots about an axis extending generally transverse of the user. Mounted on the lever is a further lever or shaft, which further lever or shaft is also moved angularly by the user. Accordingly the user performs two exercise movements which include movement about the axis extending transverse of the user, and a second axis which may extend parallel to the first axis or generally normal thereto.

9 Claims, 7 Drawing Sheets

BICEP EXERCISE DEVICE

This is a continuation of application Ser. No. 07/791,907 filed on Nov. 13, 1991, now abandoned.

TECHNICAL FIELD

The present invention relates to an exercise device and more particularly to an exercise device which permits the user to perform two exercise motions.

BACKGROUND OF THE INVENTION

Known exercise devices such as rowing machines and some exercise bicycles, which in addition to providing a leg function, enable the user to exercise the arms and the upper chest by providing pivoted handles which the user grips and causes angular reciprocation of the handles. There are also known machines which exercise the user's legs by providing vertically reciprocal foot pads to which the user applies alternate pressure. In combination with these foot pads there is provided pivoted levers which are angularly oscillated by the user.

OBJECT OF THE INVENTION

The above described exercise devices do not provide for simultaneous exercise employing rotation of the user's wrists and angular movement of the user's arms.

It is the object of the present invention to overcome or substantially ameliorate the above disadvantages.

SUMMARY OF THE INVENTION

There is disclosed herein an exercise machine comprising:

a base frame;

an arm assembly mounted on the frame and including, a lever pivotally mounted on said frame for pivoting movement about a first axis, a movement transfer member, mounted on said lever for angular movement relative thereto about a second axis, handle means on said member to be gripped by a user to apply forces thereto to cause pivoting of said lever and angular movement of said member;

means to resist movement of said levers; and support means to position the user's body so that said axes are positioned to be coaxial with normal pivoting axes of the user's body.

BRIEF DESCRIPTION OF THE DRAWINGS

Preferred forms of the present invention will now be described by way of example with reference to the accompanying drawings wherein.

DESCRIPTION OF THE PREFERRED EMBODIMENTS

Figure 1:
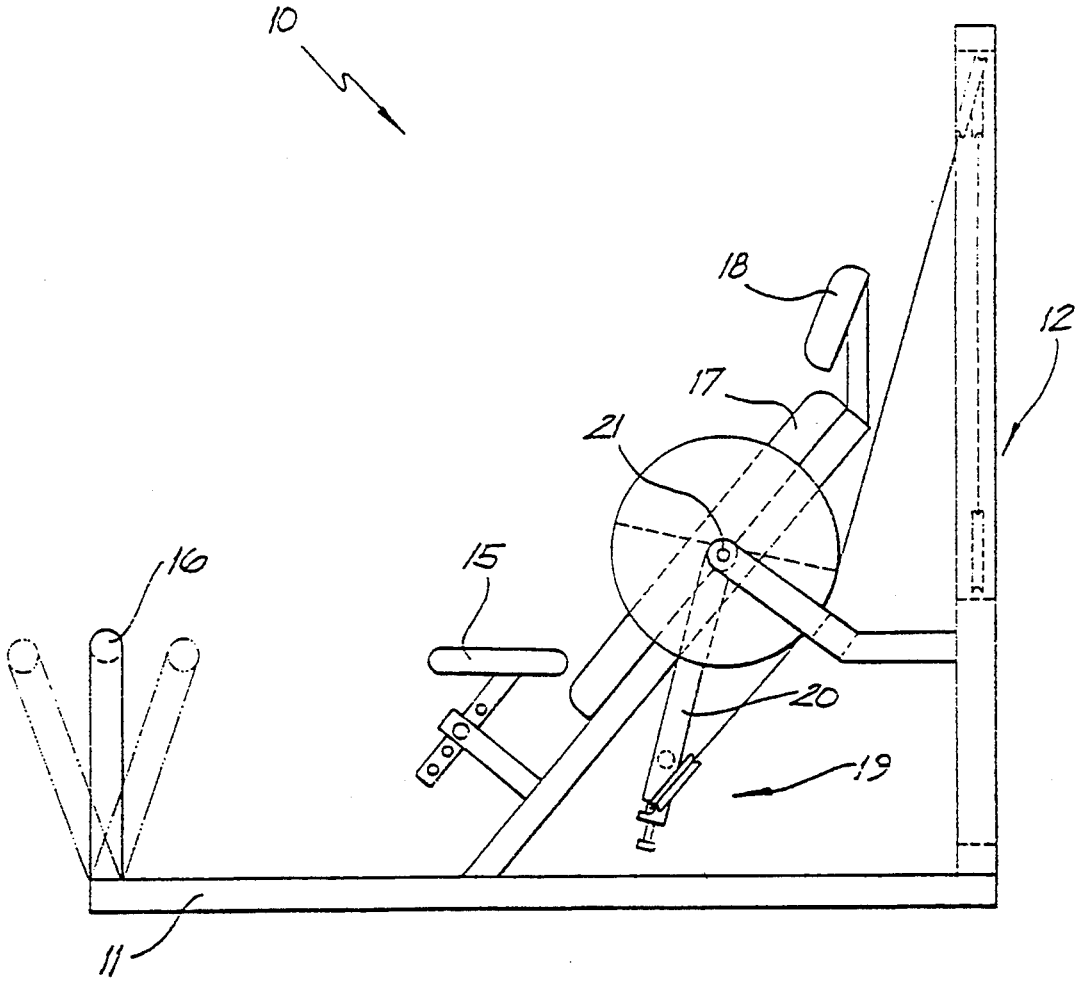
FIG. 1 is a schematic side elevation of an exercise machine.
Figure 2:
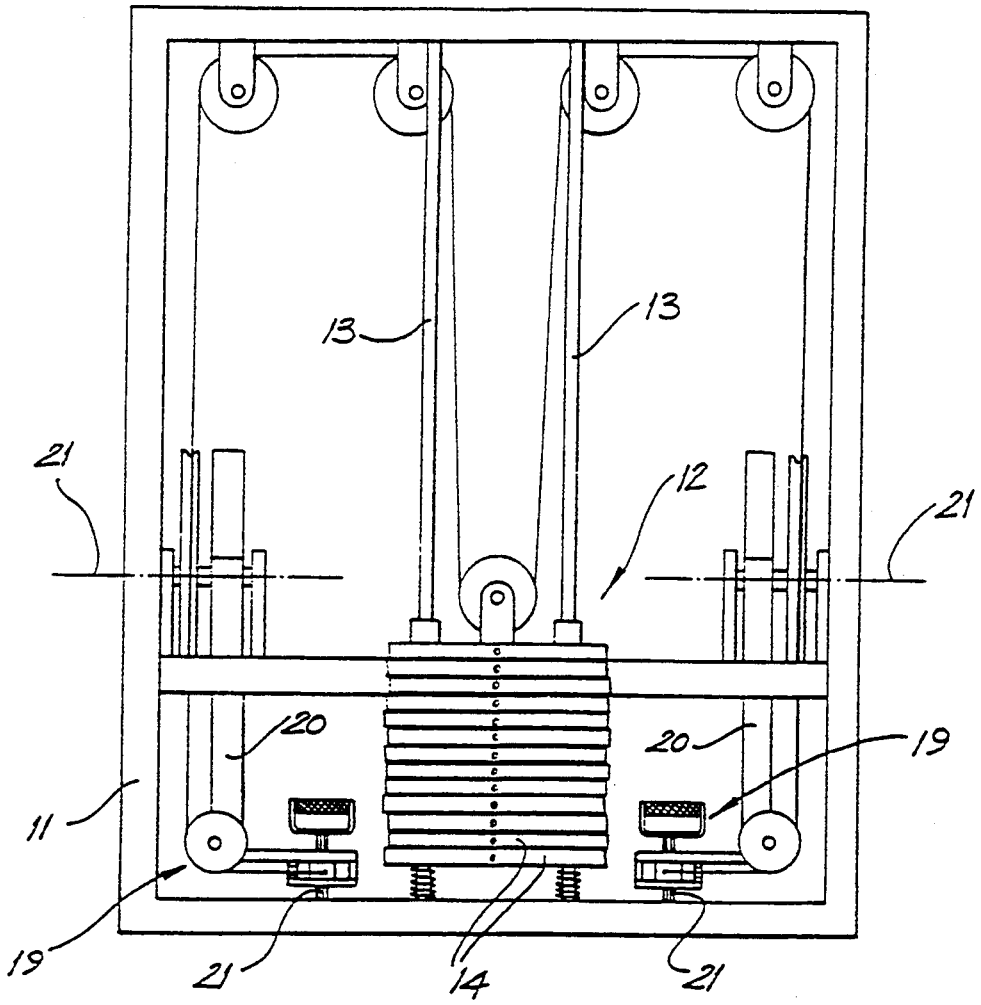
FIG. 2 is a schematic end elevation of the exercise machine of FIG. 1.
Figure 3:
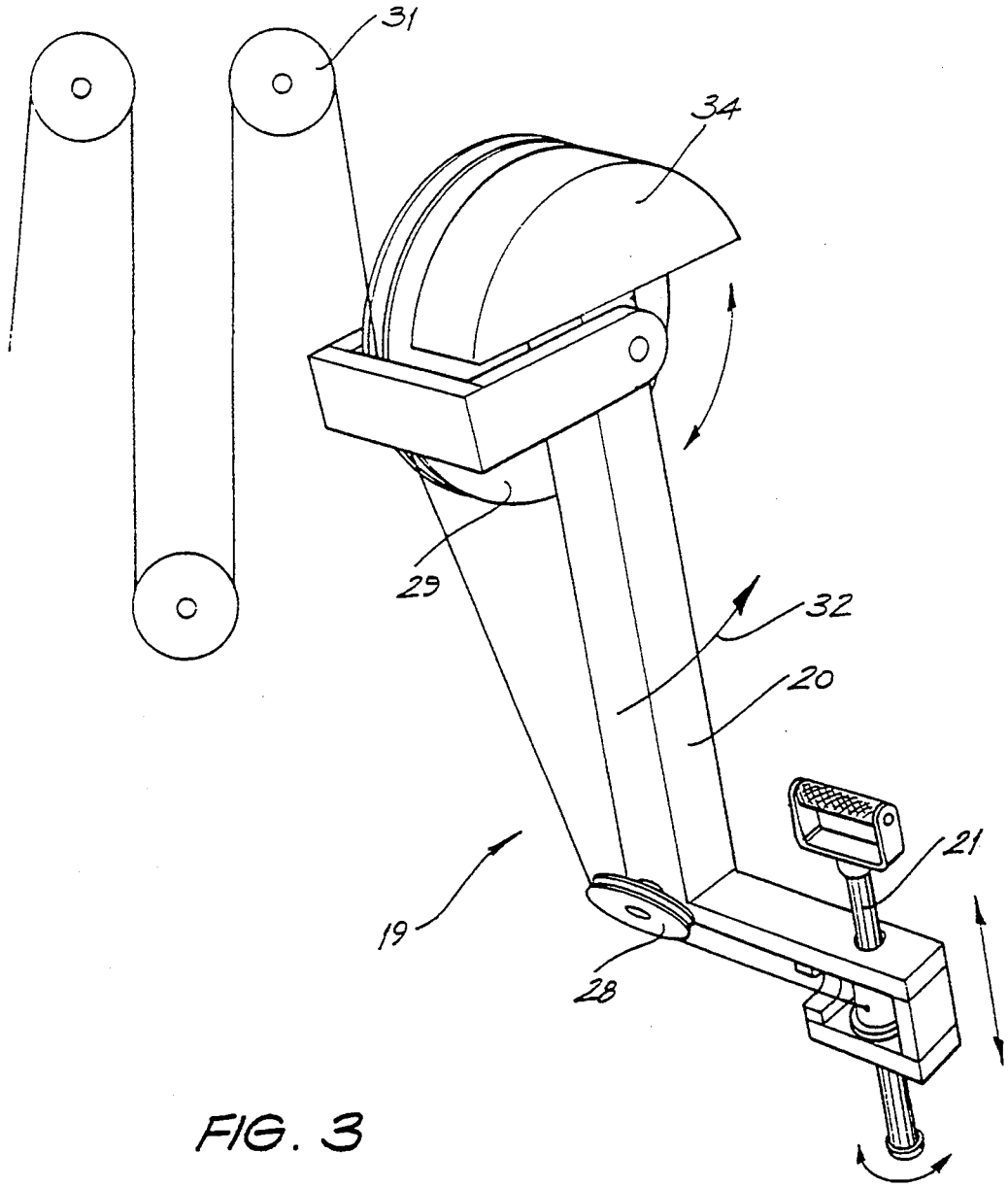
FIG. 3 is a schematic perspective view of the resistance portion of the exercise machine of FIG. 1.
Figure 4:
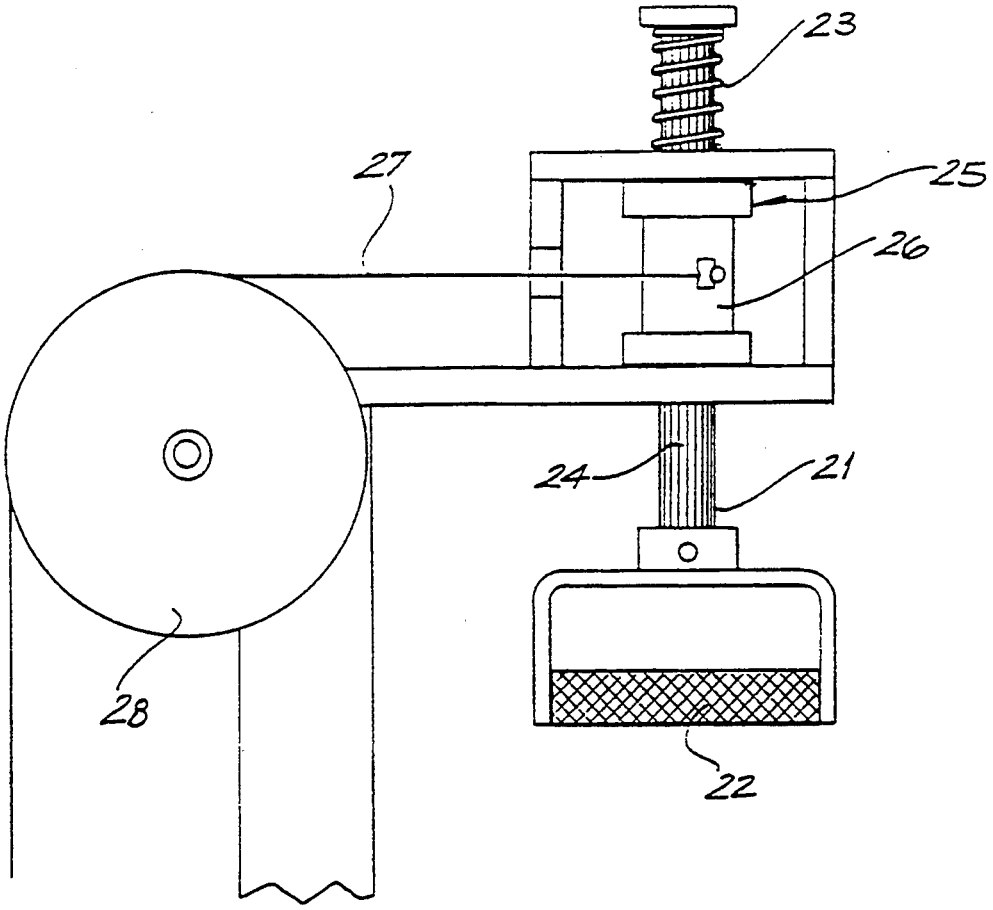
FIG. 4 is a schematic top plan view of a handle portion of the machine of FIG. 1.

In FIGS. 1 to 4 there is schematically depicted an exercise machine (bicep-supinator) 10. The exercise machine 10 has a base frame 11 which supports a weight stack 12. The weight stack 12 is received by a pair of vertically extending guide rods 13 which guide the weight stack 12 in its vertical movement. The weight stack 12 consists of a plurality of weights 14 which may be selectively coupled together to be lifted by the user of the machine 10.

Mounted on the frame 11 is an adjustable seat 15 and an adjustable footrest 16. There is also provided a back support 17 and a head rest 18.

Located on each side of the seat 15 are arm assemblies 19, with each assembly 19 being associated with the weight stack 12. The arm assemblies 19 are manipulated by the user.

Each arm assembly 19 includes a primary lever 20 which is pivotally mounted for rotation about a horizontal axis 21 extending generally transverse of the user. Mounted on the extremity of each arm 20 is a shaft 21 which is supported for rotation about its longitudinal axis. Attached to each shaft 21 is a hand grip 22 which the user grips. The shaft 22 is also slidingly mounted for longitudinal movement along its axis and is biased to a predetermined position by means of the spring 23. More particularly, the shaft 21 has splines 24 which are received within a splined passage passing through the hub 25. Mounted on the hub 25 is a pulley 26. Extending from and attached to the pulley 26 is an elongated flexible element 27 which can be a belt, chain or cable. The element 27 passes around pulleys 28, 29 and 30 to pass around a final pulley 31.

Also attached to the arm 20 is a counter-weight 34.

In operation of the above described device 10, the user grips the handle 22 and rotates the shaft 21 about its longitudinal axis. This causes the associated weight stack 12 to rise. In addition to that, movement of the arm 20 in the direction of the arrow 32 again causes the associated weight stack 12 to rise. Accordingly the weight stack 12 provides resistance to both movement of the shaft 21 and the arm 20.

It should be appreciated that both arm assemblies 19 are operatively associated with the weight stack 12.

In this embodiment, the user from a seated position reaches down and grabs the handles 22 and pulls them upward while turning their wrist about the longitudinal axis of the lower part of the arm.

It should be appreciated that pivoting of the lever 20 occurs about a normal pivot axis of the body, and that the machine 10 could be modified to enable the user to perform a twisting exercise with a "curling" exercise. This would be achieved by raising the arm assemblies 19 and providing an elbow rest.

Additionally the exercises performed on the machine 10 could be reversed by altering the effect of the element 27 so that the weight stack 12 was raised by the reverse movement.

Figure 5:
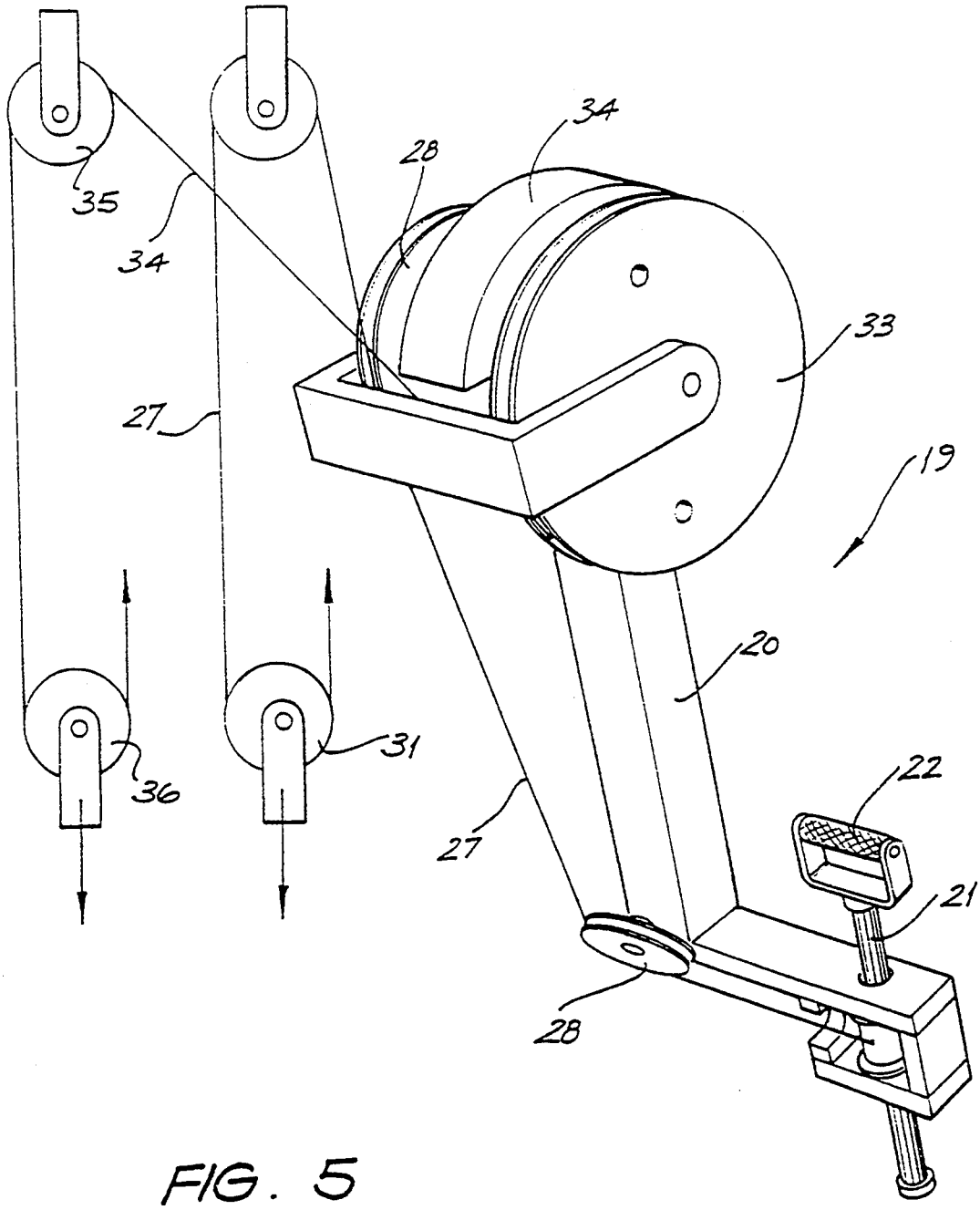
FIG. 5 is a schematic perspective view of a modification of the exercise machine of FIG. 1.

In FIG. 5, there is schematically depicted a still further modification of the machine 10. In this particular embodiment the resistance applied to the handle 22 is separated from the resistance applied to the lever 20. In this particular embodiment, the element 27 is associated with the pulley 28 so that movement of the arm 20 does not influence or alternatively has minimum influence on the resistance applied to the handle 22. Also fixed to the arm 20 is a pulley 33 to which there is attached an elongated flexible element 34. The element 34 passes around a pulley 35 to a final pulley 36 to which may be attached a weight stack. The pulley 33 may be of a circular configuration, or whatever shape desired in order to vary the resistance applied to the arm 20.

As a still further modification, the elements 27 and 34 may be operatively associated with the same weight stack. However in this particular embodiment, the pulleys 31 and 36 are operatively associated with separate weight stacks.

Figure 6:
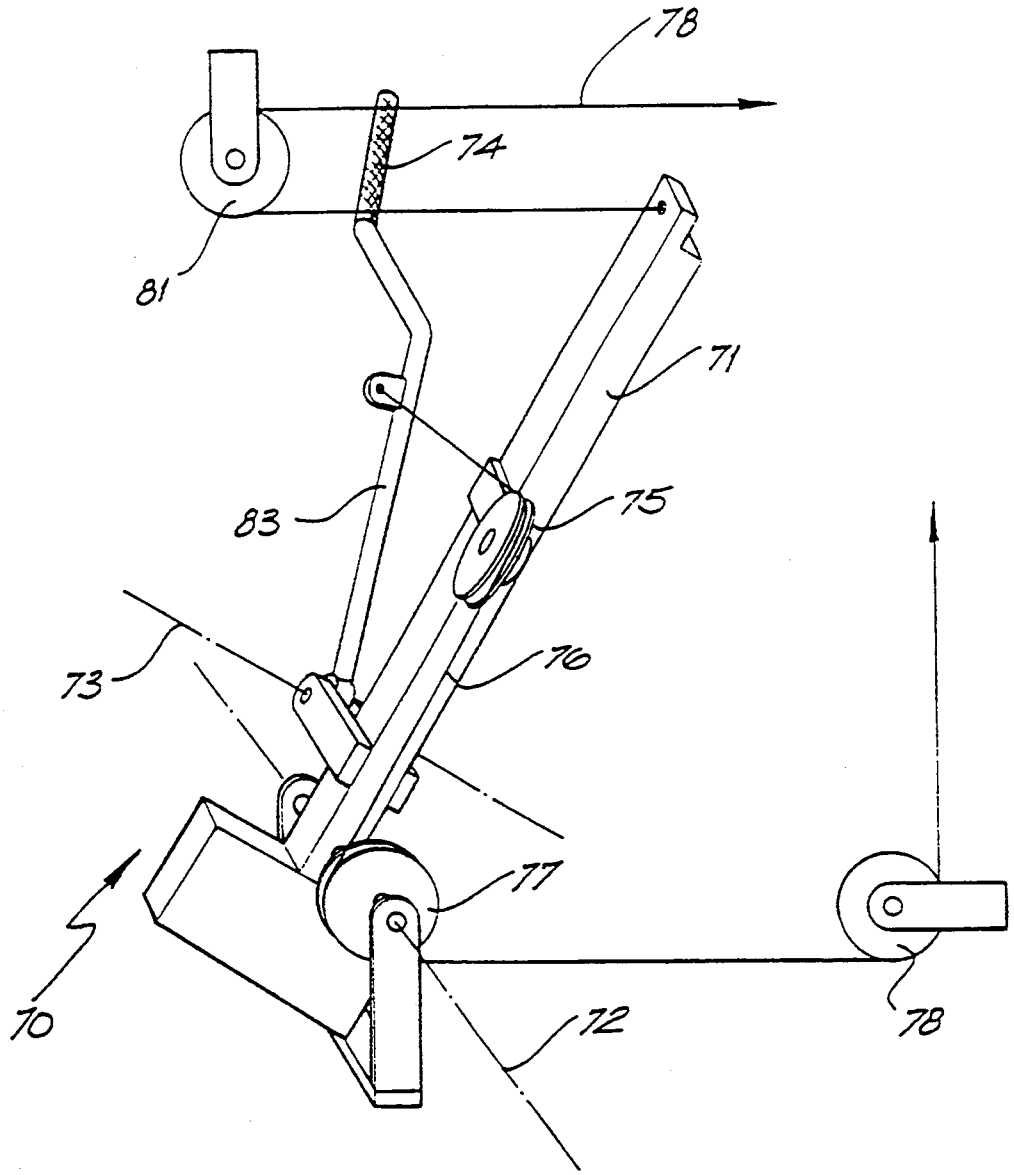
FIG. 6 is a schematic perspective view of a second exercise machine.

In FIG. 6 there is schematically depicted an exercise machine 70. The machine 70 is adapted to perform a "chest press" and "fly operation". The machine 70 has a pivotally supported arm 71 for rotation about an axis 72. Pivotally mounted on the arm 71 is a further arm 83 which pivots about an axis 73. The arm 83 has a handle 74 which is gripped by the user.

Also mounted on the arm 71 is a pulley 75 about which there passes an elongated flexible element 76. The element 76 is attached to the arm 72 so as to move with the handle 74 upon operation by the user. The element 76 passes around pulleys 77 to a weight stack not illustrated. However the weight stack would function in the same manner as the stack 12.

Fixed to the frame is a pulley 81 around which an element 79 passes. The element 79 is attached to the arm 71. The element 79 extends to the same or a separate weight stack.

In use of the above described machine 70, the user causes pivoting of the lever 71 in the direction of the arrow A and pivoting of the lever 72 in the direction of the arrow B. The element then causes movement of their associated weight stacks.

Figure 7:
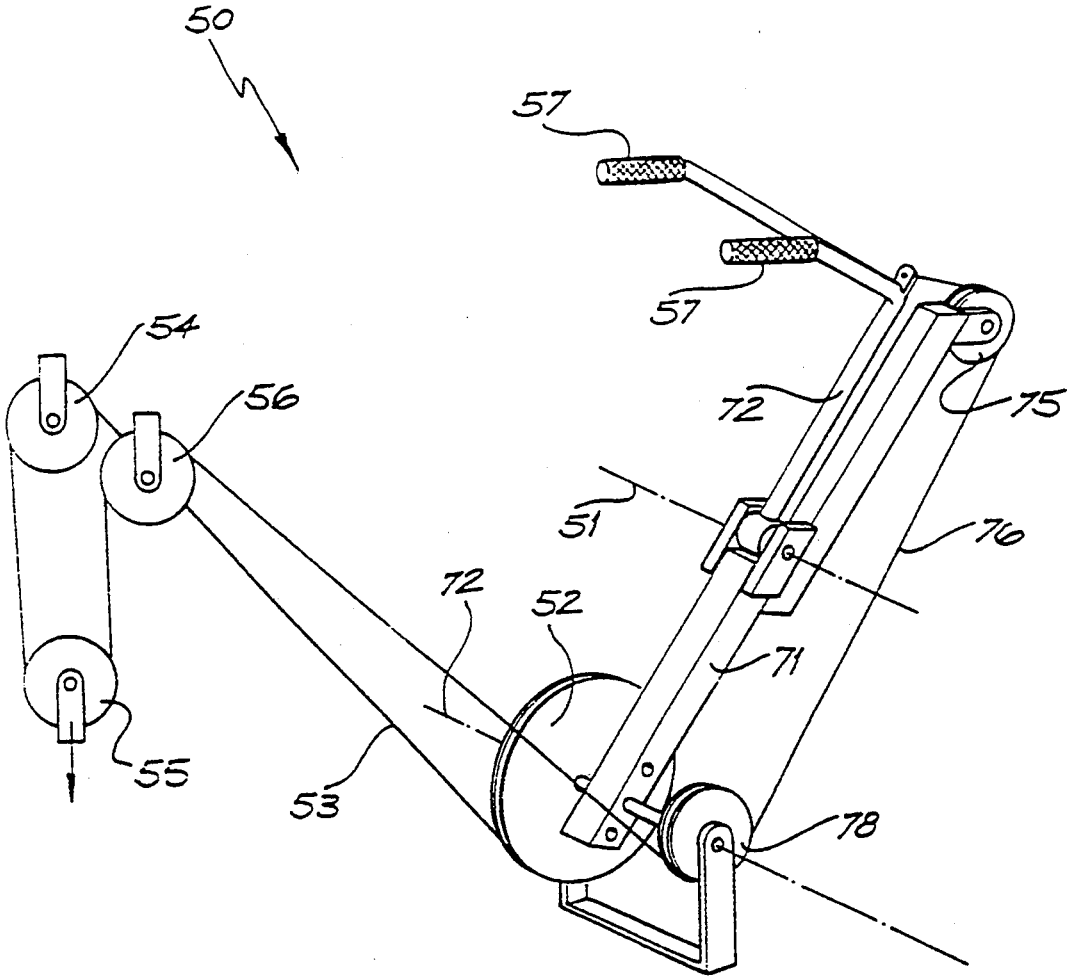
FIG. 7 is a schematic perspective view of a third exercise machine.

In FIG. 7 there is schematically depicted an exercise machine 50 which is adapted to perform a "sit-up" and "abdominal crunch" type functions.

The machine 50 has been allocated the same numerals as the machine 50 of FIG. 7. However as can be seen from FIG. 8, the lever 72 pivots about an axis 51 which is normal to the axis 73 of FIG. 6.

In use of the machine 50, the user not only causes operation of the machine 100 by pivoting movement at the hip, but also pivoting movement about an axis passing through the back of the user.

Fixed to the arm is a pulley 52 to which is attached an elongated flexible element 53. The element 53 passes around a pulley 54 to a final pulley 55. The pulley 55 would be attached to a weight stack. In this particular embodiment, the element 76 passes around a pulley 56 to be also attached to the pulley 55 and in effect to be integral with the element 53. However the elements 76 and 53 may extend to separate weight stacks. The pulley 52 of this embodiment is circular however it could be eccentrically mounted or co-axially mounted with respect to the rotational axis 72. As a still further modification, the pulley 52 may have a non-circular periphery in order to vary the resistance applied to the lever 71.

The lever 72 is provided with a pair of handles 57 to provide for simple adjustment to individual users.

What I claim is:

1. A bicep exercise device comprising:

a base frame;

an arm mounted on said base frame for pivoting movement about a first axis;

said arm further comprising an off-set portion for receiving a rotatable shaft;

said rotatable shaft, mounted on said off-set portion and extending toward said first axis, said rotatable shaft terminating in a hand grip, said hand grip being generally perpendicular to said shaft;

first means for imposing a resistive force to rotation of said arm about said first axis;

second means for imposing a resistive force to rotation of said shaft; and wherein said rotatable shaft is splined and slides within a splined passage in a hub; and said hub being mechanically linked with said second means.

2. The device of claim 1, wherein:

said second means further comprises a weight stack which is mechanically coupled to said hand grip by a flexible element and a series of pulleys over which said flexible element passes.

3. The device of claim 1 wherein:

said first and second means comprise separate weight stacks, the weight stack of said first means mechanically coupled to said arm and the weight stack of said second means coupled to said hand grip.

4. The device of claim 1, wherein:

said first and second means are each coupled to a common weight stack.

5. The device of claim 1, wherein:

said hub acts as a spool for a flexible member which is attached at one end to said hub and which acts on a means for resisting rotation of said hub.

6. The device of claim 1, wherein:

said second means further comprises a weight stack which is mechanically coupled to said hand grip by a flexible element and a series of pulleys over which said flexible element passes.

7. The device of claim 1, wherein:

said first and second means comprise separate weight stacks, the weight stack of said first means mechanically coupled to said arm and the weight stack of said second means coupled to said hand grip.

8. A bicep exercise device comprising:

a base frame;

an arm mounted on said base frame for pivoting movement about a first axis;

said arm further comprising an off-set portion for receiving a rotatable shaft;

said rotatable shaft, mounted on said off-set portion and extending toward said first axis, said rotatable shaft terminating in a hand grip, said hand grip being generally perpendicular to said shaft;

first means for imposing a resistive force to rotation of said arm about said first axis;

second means for imposing a resistive force to rotation of said shaft; and wherein said first and second means comprise separate weight stacks, the weight stack of said first means mechanically coupled to said arm and the weight stack of said second means coupled to said hand grip.

9. A bicep exercise device comprising:

a base frame;

an arm mounted on said base frame for pivoting movement about a first axis;

said arm further comprising an off-set portion for receiving a rotatable shaft;

said rotatable shaft, mounted on said off-set portion and extending toward said first axis, said rotatable shaft terminating in a hand grip, said hand grip being generally perpendicular to said shaft;

first means for imposing a resistive force to rotation of the arm about said first axis;

second means for imposing a resistive force to rotation of said shaft; and wherein said first and second means are each coupled to a common weight stack.

* * * * *